US007511430B2

(12) United States Patent
Genz

(10) Patent No.: US 7,511,430 B2
(45) Date of Patent: Mar. 31, 2009

(54) METAL HALIDE LAMP

(75) Inventor: Andreas Genz, Berlin (DE)

(73) Assignee: Osram Gesellschaft mit Beschraenkter Haftung, Munich (DE)

( * ) Notice: Subject to any disclaimer, the term of this patent is extended or adjusted under 35 U.S.C. 154(b) by 341 days.

(21) Appl. No.: 11/399,495

(22) Filed: Apr. 7, 2006

(65) Prior Publication Data

US 2006/0226784 A1 Oct. 12, 2006

(30) Foreign Application Priority Data

Apr. 7, 2005 (DE) ..... 10 2005 016 048

(51) Int. Cl.
*H01J 17/20* (2006.01)

(52) U.S. Cl. ..... 313/639; 313/641

(58) Field of Classification Search ..... 313/637, 313/638, 639, 640, 641
See application file for complete search history.

(56) References Cited

U.S. PATENT DOCUMENTS

| | | | | |
|---|---|---|---|---|
| 3,497,754 | A * | 2/1970 | Johnson | 313/578 |
| 4,782,266 | A | 11/1988 | Heider et al. | |
| 5,694,002 | A | 12/1997 | Krasko et al. | |
| 6,107,742 | A | 8/2000 | Seki et al. | |

FOREIGN PATENT DOCUMENTS

| | | |
|---|---|---|
| DE | 198 14 353 | 4/1997 |
| DE | 103 25 554 | 6/2003 |

* cited by examiner

*Primary Examiner*—Vip Patel

(57) ABSTRACT

A metal halide fill for forming an ionizable fill comprises at least one inert gas, mercury and metal halides, the fill comprising the constituents Hg halide, Na halide, Tl halide and halides of the rare earths. This fill may be contained in particular in the discharge vessel of a metal halide lamp which has an outer bulb.

13 Claims, 3 Drawing Sheets

METAL HALIDE LAMP

TECHNICAL FIELD

The invention is based on a metal halide lamp for a high-pressure discharge lamp with an ionizable fill having at least one inert gas, mercury and metal halides, having at least one halogen, the fill comprising Tl, Na, Li and rare earths as metals for halides. It deals in particular with fills for lamps with a warm-white luminous color.

BACKGROUND ART

To achieve warm-white luminous colors, metal halide discharge lamps generally contain tin iodide. However, this also requires accurate dosing with metallic tin. As a fill in the discharge vessel, the lamp often includes, in addition to mercury and a noble gas, metal iodides and metal bromides of sodium, tin, thallium, indium and lithium. Tin-containing fills of this type often have a luminous flux which is too low and lead to electrode corrosion and electrode burn-back. Tin-containing fills of this type therefore require special electrodes which are able to withstand this particularly aggressive fill, cf. for example U.S. Pat. No. 4,782,266. When producing lamps of this type, this entails longer changeover times when changing lamp type and therefore involves high storage costs.

Furthermore, U.S. Pat. No. 5,694,002 has disclosed a lamp which contains a metal halide fill comprising the metals Na, Sc, Li, Dy and Tl, with a warm-white luminous color. The color temperature is 3000 K.

Scandium-containing fills of this type have a very poor maintenance, which means that the luminous flux drops considerably during the operating time. Moreover, the color rendering of scandium-based lamps is relatively poor.

US-A 2004253897 has disclosed a metal halide lamp with a two-ended outer bulb which surrounds only part of the discharge vessel.

DISCLOSURE OF THE INVENTION

It is an object of the present invention to provide a metal halide fill for metal halide discharge lamps with an ionizable fill having at least one inert gas, mercury and metal halides, having at least one halogen, the fill comprising Tl, Na, Li and rare earths as metals for halides, which is particularly adapted to the conditions of a gas-filled outer bulb.

This object is achieved by the following features:

the fill additionally also comprises Hg halide.

Particularly advantageous configurations are given in the dependent claims.

The invention uses a metal halide fill which uses Na, Tl and rare earths and, in addition, Li halide. To avoid scandium or tin, mercury halide, preferably iodide, is additionally used. This improves the maintenance. In this case, other components with further halides are not used. The halogen used is iodine and/or bromine. The rare earths used are preferably Dy, Ho and Tm simultaneously, in order to achieve the highest possible color rendering.

When producing metal halide lamps with discharge vessels made from quartz glass, moreover, it has been found that considerable cost savings can be achieved by using a new design with an outer bulb, in which the outer bulb only partially surrounds the discharge vessel. A gas fill is used in the outer bulb. However, this leads to an altered temperature balance for the discharge vessel. The fill comprising metal halides including scandium or tin that has hitherto been customary is too unstable under these conditions to achieve a long service life.

The accurately metered addition of mercury halide remedies this problem.

In this case, a fill which contains halides of rare earths (RE), sodium, thallium and lithium is used. The fill contains between 0.1 and 2.5 mg of RE iodide per ml of bulb volume. A value of between 0.2 and 2.0 mg/ml is preferred. The fill additionally contains 0.1 to 2.0 mg of mercury iodide or mercury bromide per ml of bulb volume. A value of from 0.12 to 1.2 mg/ml is preferred. In particular, the molar ratio between RE and lithium is between 1.0 and 15, preferably between 1.2 and 12. Recommended RE metals are Dy and/or Ho and/or Tm and it is preferable to use a mixture of all three. The halogen used is iodine or bromine. It is preferable for the fill to contain more iodine than bromine. In particular, iodine alone is used, with a bromine content of at most 10% in molar terms.

If the fill quantity for rare earths is exceeded, the color temperature becomes too low. If the quantity of rare earths in the fill is below the lower limit, the color temperature becomes too high.

If the molar ratio of RE to Li is exceeded, the color temperature becomes too high. If the molar ratio of RE to Li is below the lower limit, the luminous flux becomes too low.

If the fill quantity for $HgI_2$ is exceeded, the color temperature and the luminous flux become too low. If the fill quantity for $HgI_2$ is below the lower limit, the drop in luminous flux during the service life becomes too great.

The color temperature of the lamp is preferably in the warm-white range with a color temperature from 2600 to 3800 K.

The specific power, given in watts per mm of arc length, is preferably between 5 and 25 W/mm.

This fill is preferably suitable for general illumination purposes for lamps with a rate of power from 50 to 1000 W. It is therefore used for low to medium luminous densities. Here, the wall loading is typically less than 40 W/cm$^2$, the specific power less than 30 W/mm arc length, and the electrode gap is more than 5 mm.

It is in this way possible to achieve a long service life, typically of more than 4000 hours, and at the same time a high luminous flux.

BRIEF DESCRIPTION OF THE DRAWINGS

The text which follows is intended to provide a more detailed explanation of the invention on the basis of a number of exemplary embodiments. In the drawings.

BEST MODE FOR CARRYING OUT THE INVENTION

Figure 1:
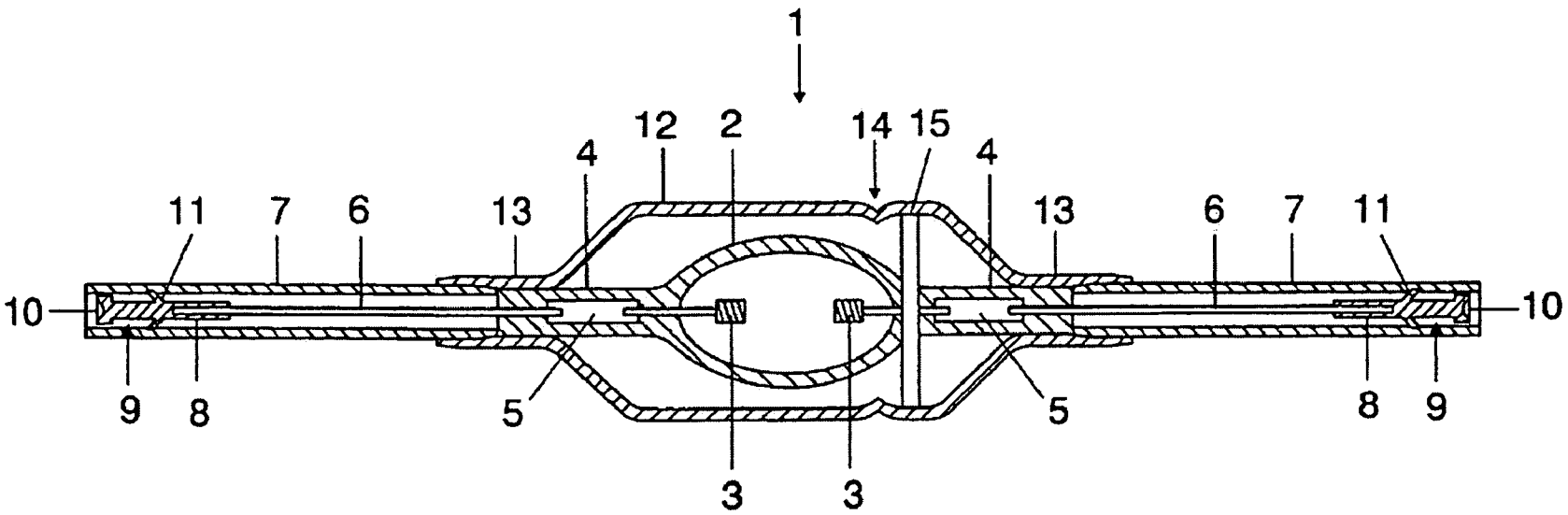
FIG. 1 shows a metal halide lamp according to the invention.

FIG. 1 shows a side view of a metal halide lamp 1 which is sealed on two sides and has a rated power of 150 W. The discharge vessel 2 made from quartz glass, which is designed as an ellipsoid, encloses two electrodes 3 as well as a metal halide fill. The bulb ends are sealed by fused seals 4 in which foils 5 are embedded. Pinches are also suitable for sealing purposes. These fused seals 4 are connected to external supply conductors 6. The external supply conductor 6 is guided within a tubular sleeve 7 and ends in a socket 8 of an integral cap part 9. The cap is produced in a single piece from steel or another heat-resistant metal and also comprises a circular disk 10 as contact element and barb 11 as centering and holding means. The convex part of the discharge vessel is partly surrounded by an outer bulb 12, which is rolled on (13) in the region of the transition between the pinch 4 and the sleeve 7.

The outer bulb 12 has an encircling indentation 14, so that an elastic support strip 15 made from metal is spread along the inner surface of the outer bulb. The support strip may if necessary contain getter materials, such as Zr, Fe, V, Co. These materials are used to absorb various substances, such as oxygen, hydrogen or the like. The outer bulb may be filled with nitrogen, noble gas, another inert gas or also a vacuum.

In another exemplary embodiment, an outer bulb gas mixture of $N_2$ and/or $CO_2$ with Ne is used to improve the ignition properties, in which case the total pressure is between 200 and 900 mbar. In this case, the starting gas used in the burner is an Ne—Ar, Ne—Kr or Ne—Ar—Kr Penning mixture. In particular an outer bulb gas mixture of $N_2$/Ne or $CO_2$/Ne with a total pressure of from 300 mbar to 900 mbar is used to maintain the good ignition properties throughout the service life. The Ne in this case forms between 25 and 60%.

Figure 2:
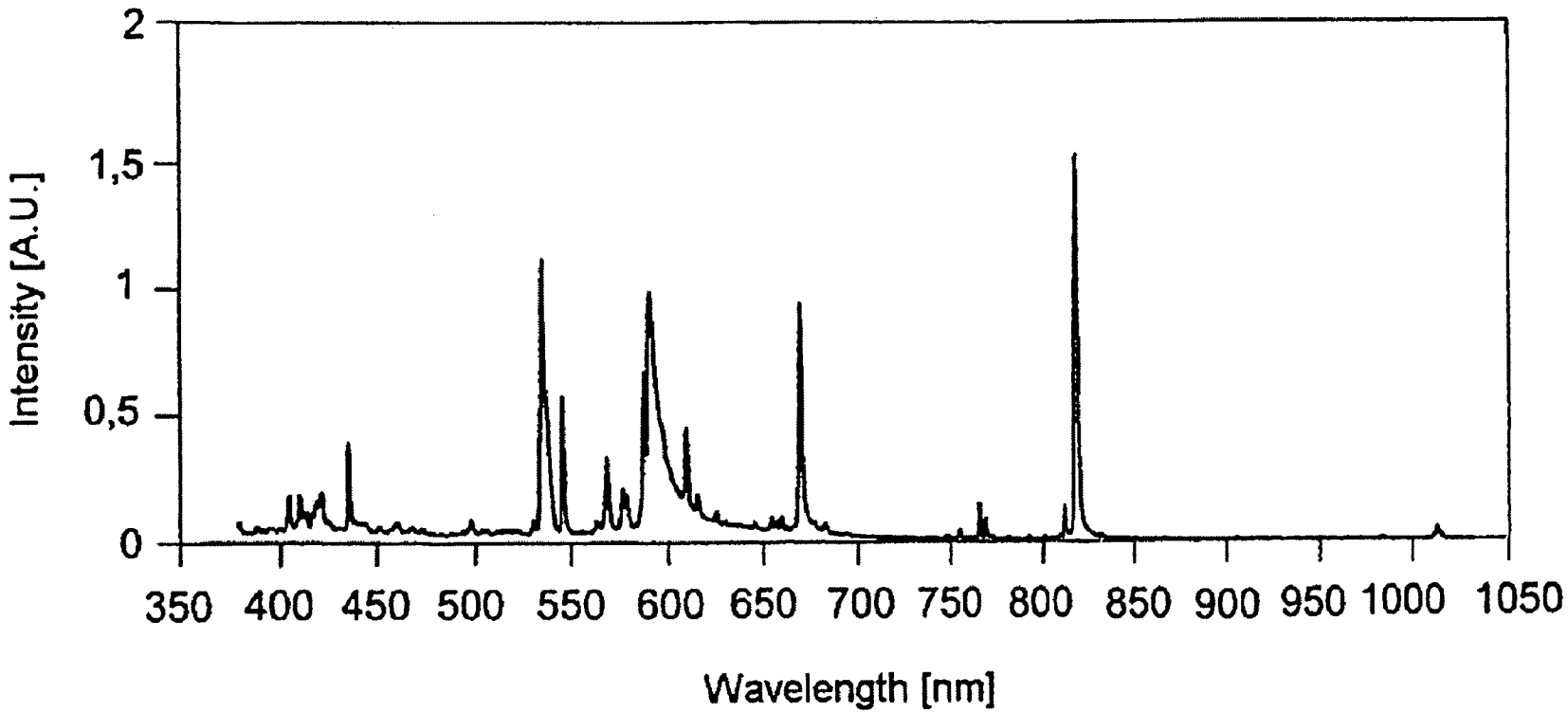
FIG. 2 shows a spectrum of this lamp.

FIG. 2 shows the spectrum of lamps after an operating time of 100 h in accordance with the exemplary embodiment shown in FIG. 1, the discharge vessel of which contains 10 mg of Hg and the metal halide fills shown in Table 1. The fill in the outer bulb is Argon.

TABLE 1

| Lamp | 150 W/WDL | 70 W/WDL |
|---|---|---|
| Power/W | 150 | 75 |
| Luminous flux/lm | 11 000 | 6000 |
| Color temperature/K | 3000 | 3000 |
| Mean service life/h | 9000 | 9000 |
| Electrode gap/mm | 15 | 8.5 |
| Burner bulb diameter/mm | 14.8 | 11.0 |
| Burner bulb length/mm | 22.3 | 22.0 |
| Bulb volume/ml | 1.6 | 0.65 |
| Burner fill gas | 100 hPa Ar | 100 hPa Ar |
| Outer bulb fill gas | 300 hPa Ar | 300 hPa Ar |
| Fill in mg | 16 mg Hg, 0.13 mg LiI, 0.45 mg DyI3, 0.45 mg HoI3, 0.45 mg TmI3, 3.68 mg NaI, 0.33 mg TlI, 0.8 mg HgI2 | 10 mg Hg, 0.05 mg LiI, 0.18 mg DyI3, 0.18 mg HoI3, 0.18 mg TmI3, 1.47 mg NaI, 0.13 mg TlI, 0.4 mg HgI2 |
| Metals in mol % | Li 3.45, Dy 2.86, Ho 2.85, Tm 2.83, Tl 3.46, Na 84.56 | Li 3.45, Dy 2.86, Ho 2.85, Tm 2.83, Tl 3.46, Na 84.56 |

A higher or lower color temperature can be set by suitably selecting the relative ratios of the metal halides. As rare earths, the fill in each case uses approximately equal proportions of Tm, Dy and Ho. These proportions may in particular fluctuate in a ratio of up to at most three times the component with the lowest representation, i.e. up to 3:3:1.

Figure 3:
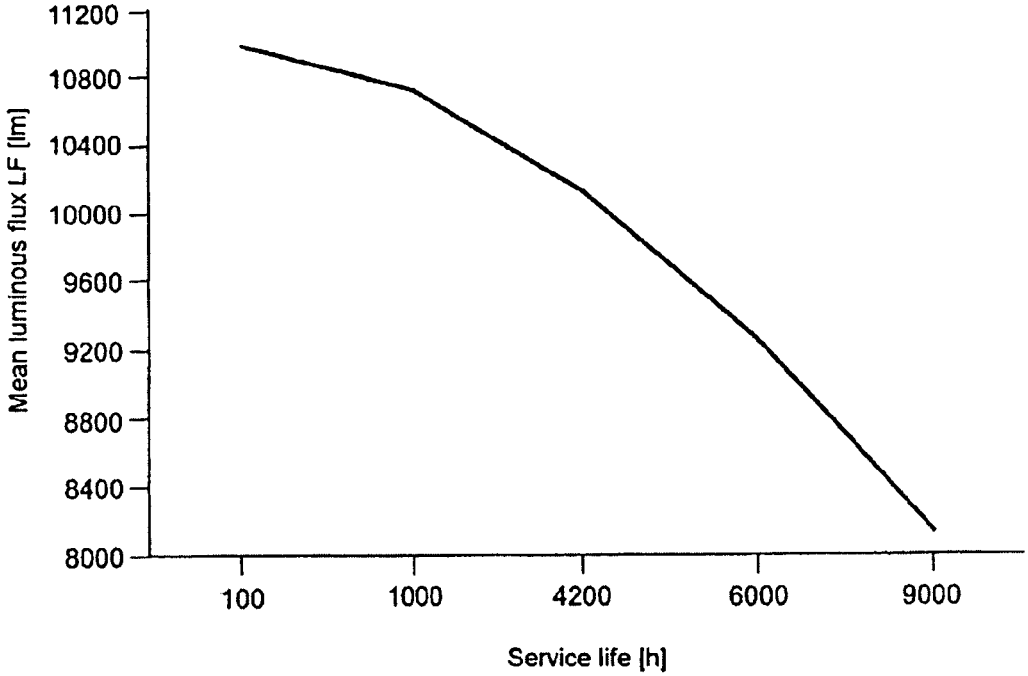
FIG. 3 shows the change in luminous flux over the life of an exemplary embodiment.
Figure 4:
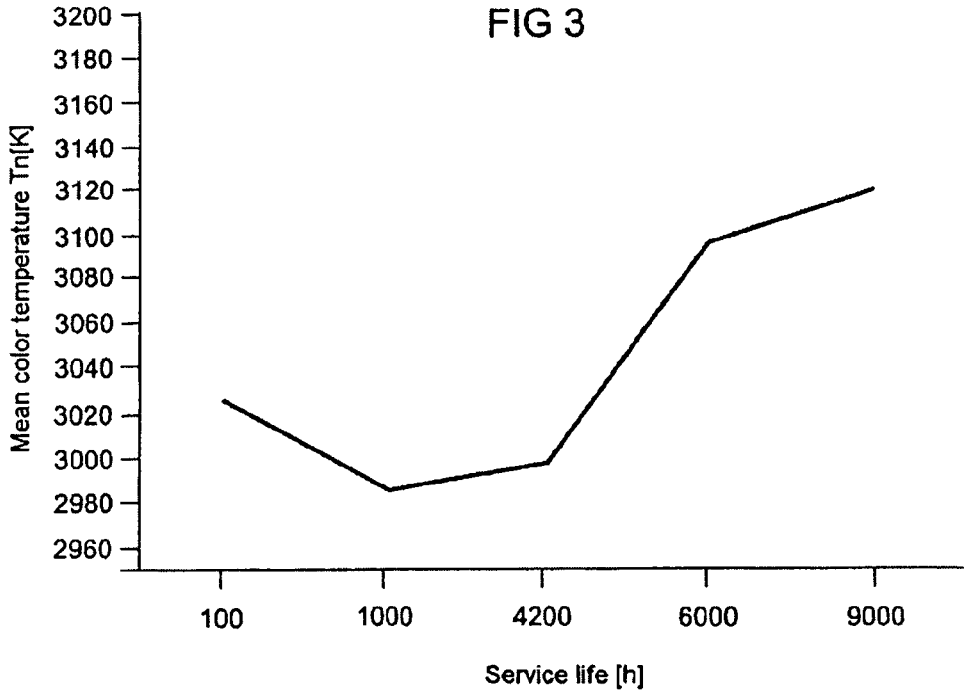
FIG. 4 shows the change in color temperature over the life of an exemplary embodiment.

FIGS. 3 and 4 show the change in the color temperature Tn and the luminous flux LF of the lamp from FIG. 1 as a function of the service life for the exemplary embodiment shown in Table 1. Both characteristic variables are extremely stable until a service life of at least 6000 hours.

Table 1 also shows the parameters for a 70 W lamp with a similar fill as that used for the 150 W lamp.

What is claimed is:

1. A metal halide lamp, comprising a sealed envelope defining an enclosed volume, the envelope having at least one electrode in electrical contact with the enclosed volume, and located in the enclosed volume an ionizable fill having at least one inert gas, mercury and metal halides, having at least one halogen, the fill comprising Tl, Na, Li and rare earths as metals for halides, the fill including Hg halide and at least halides of Dy, Ho, and Tm, in which the proportion of the largest component (in mol percent) of the halides of Dy, Ho, and Tm is at most three times the proportion (in mol percent) of the smallest component of the three halides Dy, Ho, and Tm.

2. The metal halide lamp as claimed in claim 1, wherein the fill contains between 0.1 and 2.5 mg of RE halide per ml of bulb volume of the discharge vessel.

3. The metal halide lamp as claimed in claim 2, wherein the fill contains between 0.2 and 2.0 mg of RE halide per ml of bulb volume of the discharge vessel.

4. The metal halide lamp as claimed in claim 1, wherein the halogens used for forming the halides are selected form the group including iodine and bromine.

5. The metal halide lamp as claimed in claim 4, wherein iodine together with a proportion of at most 10% of bromine is used as the halogen.

6. The metal halide lamp as claimed in claim 1, wherein the fill contains 0.1 to 2.0 mg of mercury iodide per ml of bulb volume.

7. The metal halide lamp as claimed in claim 1, wherein the molar ratio between RE and lithium is between 1.0 and 15.

8. The metal halide lamp as claimed in claim 1, wherein the lamp also comprises: an outer bulb made from hard glass or quartz glass and a discharge vessel (2) made from quartz glass and containing two electrodes (11).

9. The metal halide lamp as claimed in claim 8, wherein the space between the discharge vessel and the outer bulb contains a gas fill.

10. The metal halide lamp as claimed in claim 9, wherein the gas fill consists of 200 to 900 mbar of a gas selected from the group comprising $N_2$ or a noble gas or $CO_2$, alone or in combination.

11. The metal halide lamp as claimed in claim 1, wherein the fill contains 0.12 to 1.2 mg of mercury iodide per ml of bulb volume.

12. The metal halide lamp as claimed in claim 1, wherein the molar ratio between RE and lithium is between 1.2 and 12.

13. The metal halide lamp as claimed in claim 1, wherein the lamp also comprises: an outer bulb made from hard glass or quartz glass and a discharge vessel (2) made from quartz glass and containing two electrodes (11), the outer bulb only partially surrounding the discharge vessel.

* * * * *